United States Patent [19]

Naylor, deceased

[11] 4,441,277

[45] * Apr. 10, 1984

[54] INVERTIBLE PREFABRICATED DOOR

[76] Inventor: Donald B. Naylor, deceased, 1400 Pidco Dr., Plymouth, Ind. 46563, Marshall County Bank & Trust, executor

[ * ] Notice: The portion of the term of this patent subsequent to Jul. 24, 1996 has been disclaimed.

[21] Appl. No.: 291,295

[22] Filed: Aug. 10, 1981

Related U.S. Application Data

[63] Continuation of Ser. No. 107,036, Dec. 26, 1979, Pat. No. 4,305,229, which is a continuation-in-part of Ser. No. 27,875, Apr. 6, 1979, abandoned, which is a continuation of Ser. No. 607,028, Aug. 22, 1975, Pat. No. 4,161,845.

[51] Int. Cl.[3] ..... E06B 3/32

[52] U.S. Cl. ..... 49/380; 49/382; 49/467

[58] Field of Search ..... 49/380, 382, 501, 504, 49/467

[56] References Cited

U.S. PATENT DOCUMENTS

| | | | |
|---|---|---|---|
| 2,930,480 | 3/1960 | Brown | 49/380 X |
| 3,634,962 | 1/1972 | Peterson | 49/380 X |
| 3,796,008 | 3/1974 | Eakin | 49/380 |
| 4,161,845 | 7/1979 | Naylor | 49/380 |

FOREIGN PATENT DOCUMENTS

| | | | |
|---|---|---|---|
| 114857 | 9/1945 | Sweden | 49/380 |

*Primary Examiner*—Kenneth Downey
*Attorney, Agent, or Firm*—M. A. Hobbs

[57] ABSTRACT

A prefabricated door assembly which includes a panel, a pair of jambs and two combined headers and thresholds. The jambs and combined headers and thresholds form a rectangular frame into which is fitted the door panel. The panel is pivotally hinged to one of the jambs. Each combined headers and threshold is adapted to be mounted either upon a foundation or under an overhead support, depending upon the vertical orientation of the panel and location of the door hinge.

1 Claim, 8 Drawing Figures

Fig. 3
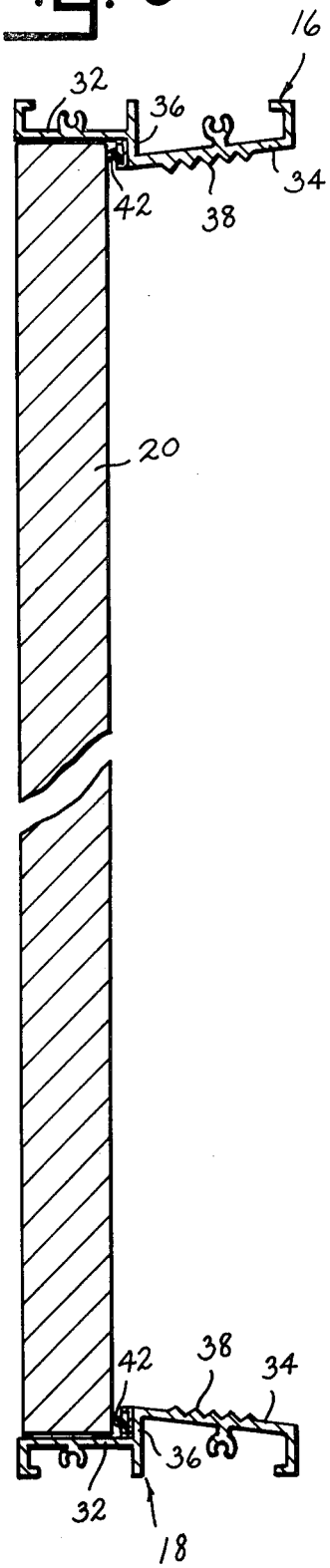
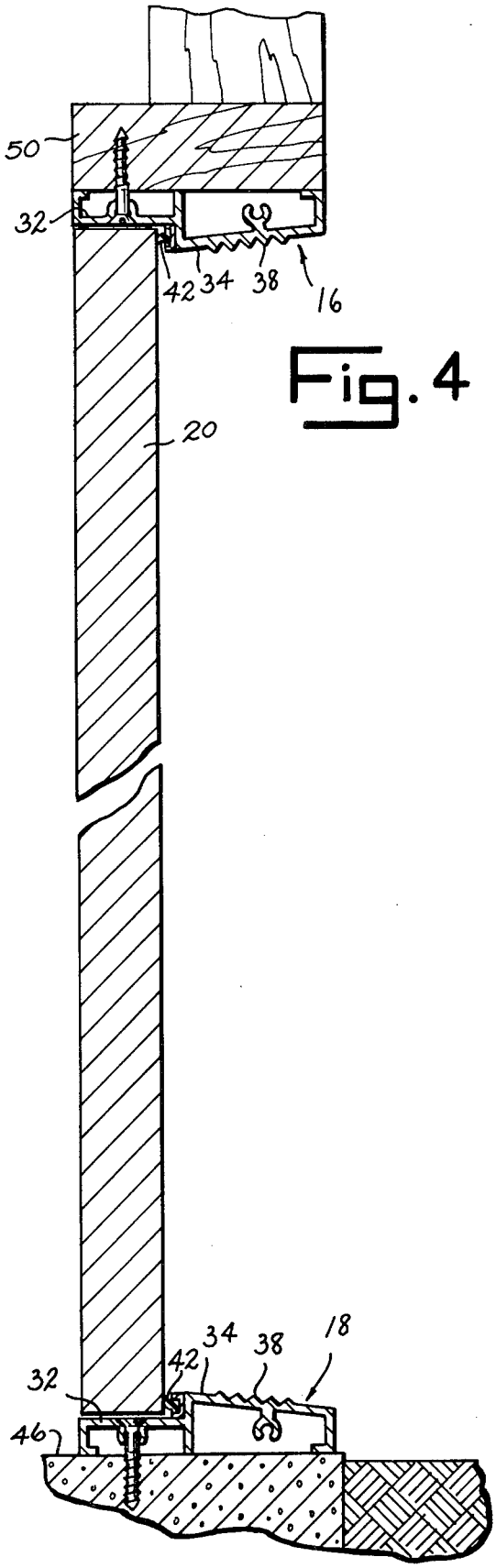
Fig. 4

INVERTIBLE PREFABRICATED DOOR

This application is a continuation of application Ser. No. 107,036, filed Dec. 26, 1979, now U.S. Pat. No. 4,305,229, issued Dec. 15, 1981, which is a continuation-in-part of application Ser. No. 27,875, filed Apr. 6, 1979, now abandoned, which is a continuation of application Ser. No. 607,028, filed Aug. 22, 1975, now U.S. Pat. No. 4,161,845, granted July 24, 1979.

SUMMARY OF THE INVENTION

This invention relates to a prefabricated door assembly and will have specific application to a door which can be inverted during its installation, depending upon the desired direction of swing of the door panel.

In the door assembly of this invention there is a panel which is hinged for pivotal movement to one of a pair of jambs. Enclosing the panel at its upper and lower edges is a pair of combined header and threshold means. The two jambs and two header and threshold means define a frame into which the door panel is fitted. Hinge means pivotally connect the door panel to one of the door jambs. Each combined header and threshold means is adapted for mounting either upon a foundation or under an overhead support, depending upon the desired vertical orientation of the panel and location of the assembly hinge means.

To mount the door assembly within a wall opening, the assembly is first rotated or inverted, if necessary, to place the hinge means at one specific side of the door panel, depending upon the desired direction of opening movement of the door. The assembly is then set into the wall opening with one of the combined header and threshold means resting upon the foundation. In this manner, one prefabricated door assembly can be utilized as a right or left-hand opening door, depending upon the vertical orientation of the assembly when fitted into the wall opening.

Accordingly, it is an object of this invention to provide a prefabricated door assembly which may be inverted to accommodate either left or right-hand opening movement of the door panel of the assembly.

Another object of this invention is to provide an invertible prefabricated door assembly which is of economical construction.

Still another object of this invention is to provide an invertible prefabricated door assembly which may be mounted within a wall opening through the utilization of simple hand tools.

Still another object of this invention is to provide an invertible prefabricated door assembly which is mountable in a rapid and simple manner.

Still another object of this invention is to provide a door assembly having a two-piece threshold with a removable shoulder part.

And still another object of this invention is to provide an invertible prefabricated door assembly having a two piece combined header-threshold.

Other objects of this invention will become apparent upon a reading of the invention's description.

BRIEF DESCRIPTION OF THE DRAWINGS

FIG. 3 is a vertical cross sectional view of the door assembly taken along line 3—3 of FIG. 2.

FIG. 4 is a vertical cross sectional view of the door assembly taken along line 4—4 of FIG. 1.

DESCRIPTION OF THE PREFERRED EMBODIMENTS

Figure 1:
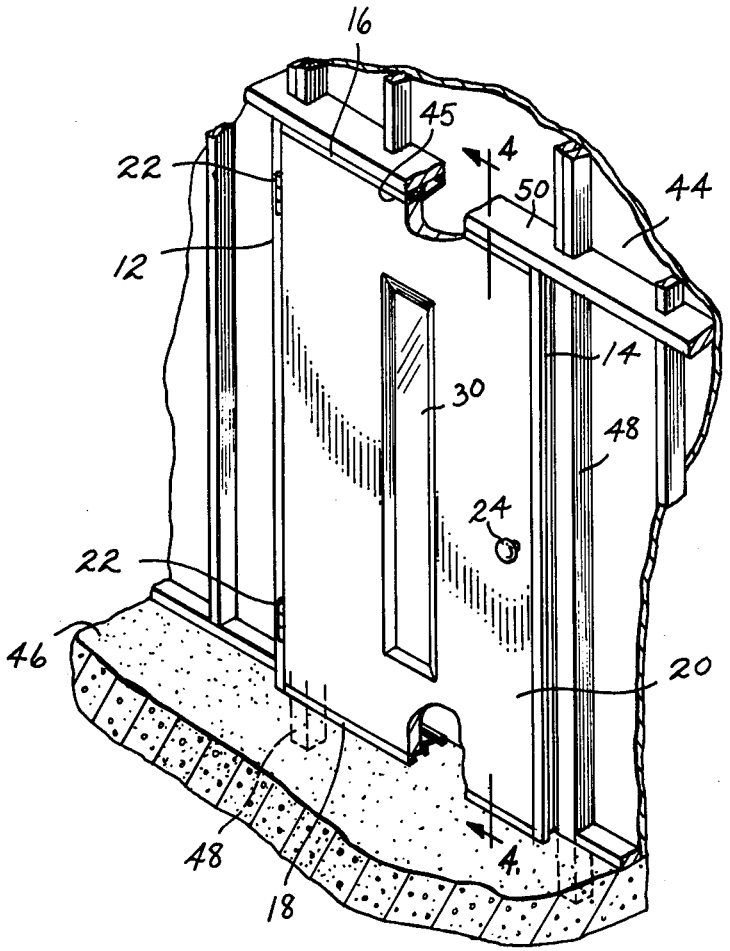
FIG. 1 is a perspective view of one embodiment of the door assembly fitted within a wall opening.
Figure 2:
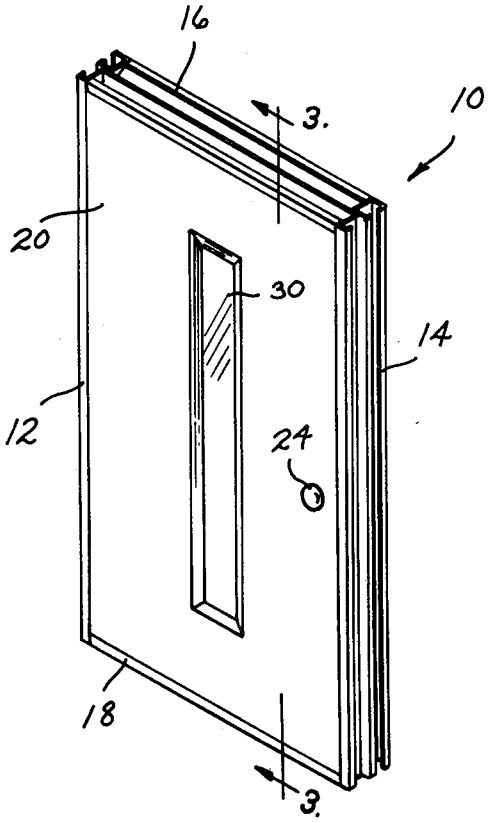
FIG. 2 is an isolated perspective view of the door assembly of FIG. 1.
Figure 5:
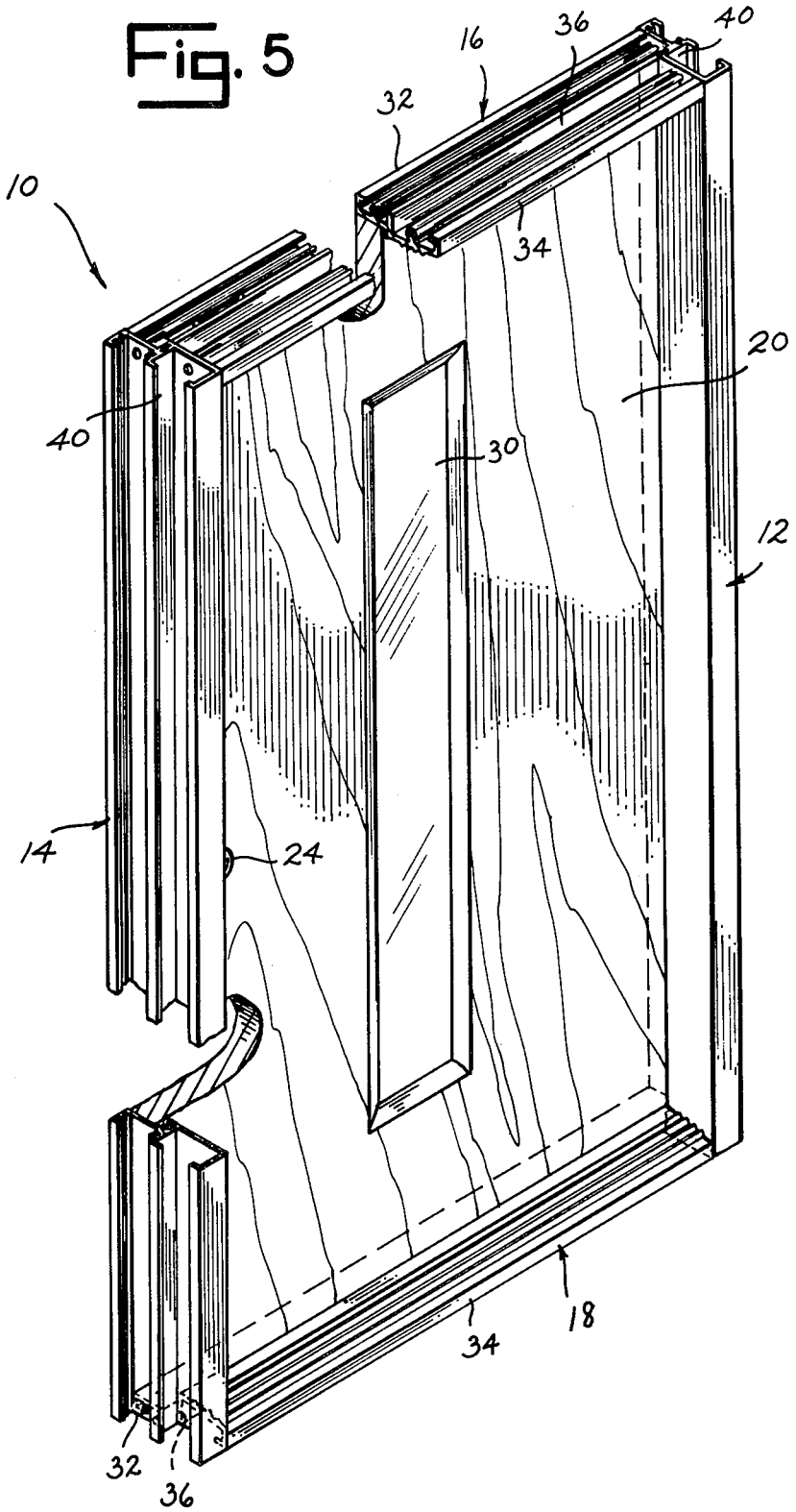
FIG. 5 is a perspective view of the isolated door assembly with portions broken away for purposes of illustration as seen from its opposite side.

The preferred embodiments illustrated are not intended to be exhaustive or to limit the invention to the precise forms disclosed. They are chosen and described in order to best explain the principles of the invention and its application and practical use to thereby enable others skilled in the art to best utilize the invention.

Door assembly 10 of FIGS. 1-5 includes jambs 12 and 14, a combined header and threshold 16 and another combined header and threshold 18. Jambs 12 and 14 and headers and thresholds 16 and 18 are connected together at their respective end portions to define a rectangular frame into which a door leaf or panel 20 is fitted. Hinges 22 secure door panel 20 to jamb 12, enabling the door to be pivoted between open and closed positions. Located an equal distance between headers and thresholds 16 and 18 is a door handle 24 and associated latch. A striker plate is carried by jamb 14 for the purpose of engaging the door latch to secure door panel 20 in its closed position. If desired, a centered window 30 may be located in door panel 20.

Combined header and thresholds 16 and 18 are of like construction. Each header and threshold 16 and 18 includes a plate part 32 and an offset plate part 34 separated by a shoulder 36. Plate part 34 may be angled as shown in the drawings. Additionally, the outer surface of plate part 34 of each header and threshold 16 and 18 may be provided with longitudinally extending serrations 38. Each jamb 12 and 14 includes offset parts connected by a shoulder 40 which lies in the same plane as shoulder 36 of each header and threshold 16 and 18. Shoulders 36 and 40 are overlapped by the marginal edges of door panel 20 when the panel is in its closed position with its latch extending into the latch opening in the striker plate. Weatherstripping 42 is applied to shoulders 36 and 40. When contacted by door panel 20 in its closed position, weatherstripping 42 serves to seal the panel around jambs 12 and 14 and combined headers and thresholds 16 and 18.

In FIG. 1 door assembly 10 is shown fitted into an opening within side wall 44 of a building structure. The opening 45 in side wall 44 is defined by a foundation 46, which may be concrete, wood or of earthen composition, side stanchions 48 and an interconnecting overhead support 10 with slight clearance. Door assembly 10 is positioned such as by inverting the door assembly if necessary, to locate hinges 22 at one selected assembly side so as to enable door panel 20 to have either a left or right-hand opening and closing swing as desired. Any inversion of door assembly 10 other than changing the orientation or location of hinges 22 and door handle 24 will not change the method by which the assembly is fitted and secured within opening 45 in side wall 44 due to the similarity in construction of header and thresholds 16 and 18. Once door assembly 10 is fitted into wall openings 45, screws or similar attachment means are turned through jambs 12 and 14 and combined headers and thresholds 16 and 18 into underlying stanchions 48 and overhead supports 50 to secure the assembly to wall 44.

From the above description it can be appreciated how easily prefabricated door assembly 10 with its combined headers and thresholds 16 and 18 can be mounted in a wall opening while giving the door user an option of having either a right or left-hand opening door, without changing or otherwise modifying the door assembly.

Figure 6:
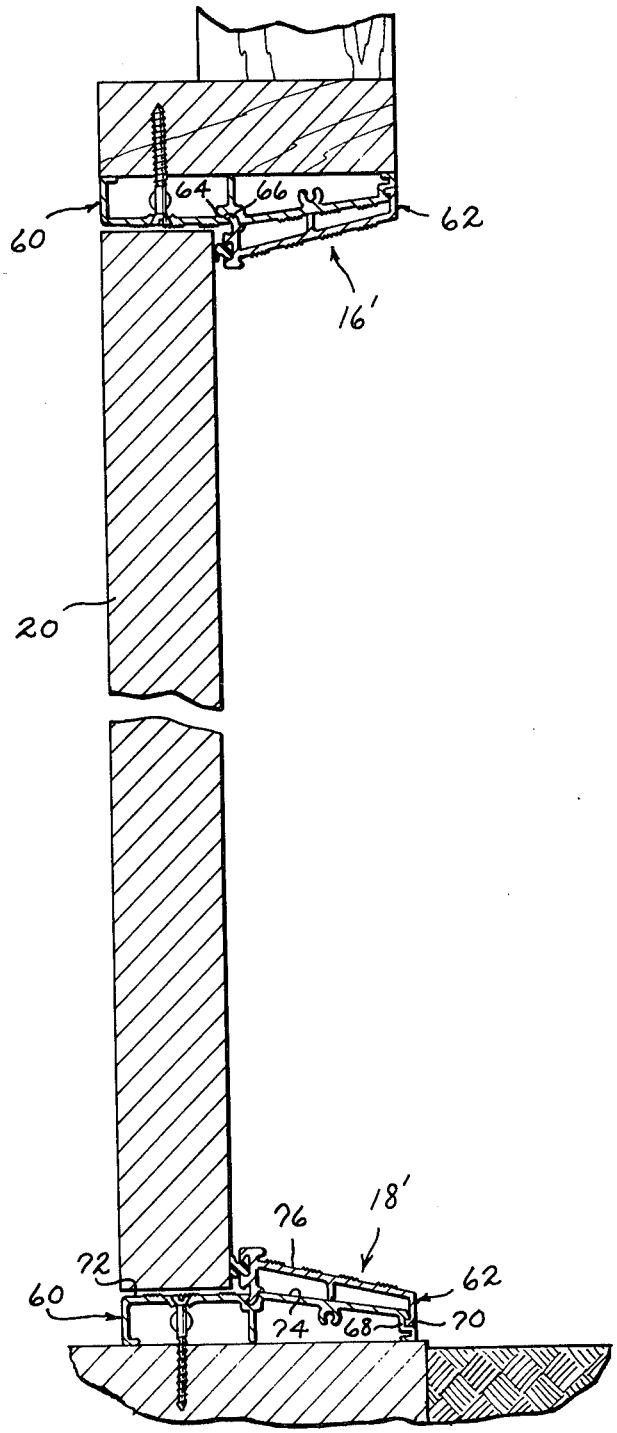
FIG. 6 is a vertical cross sectional view of another embodiment of the door assembly.
Figure 7:
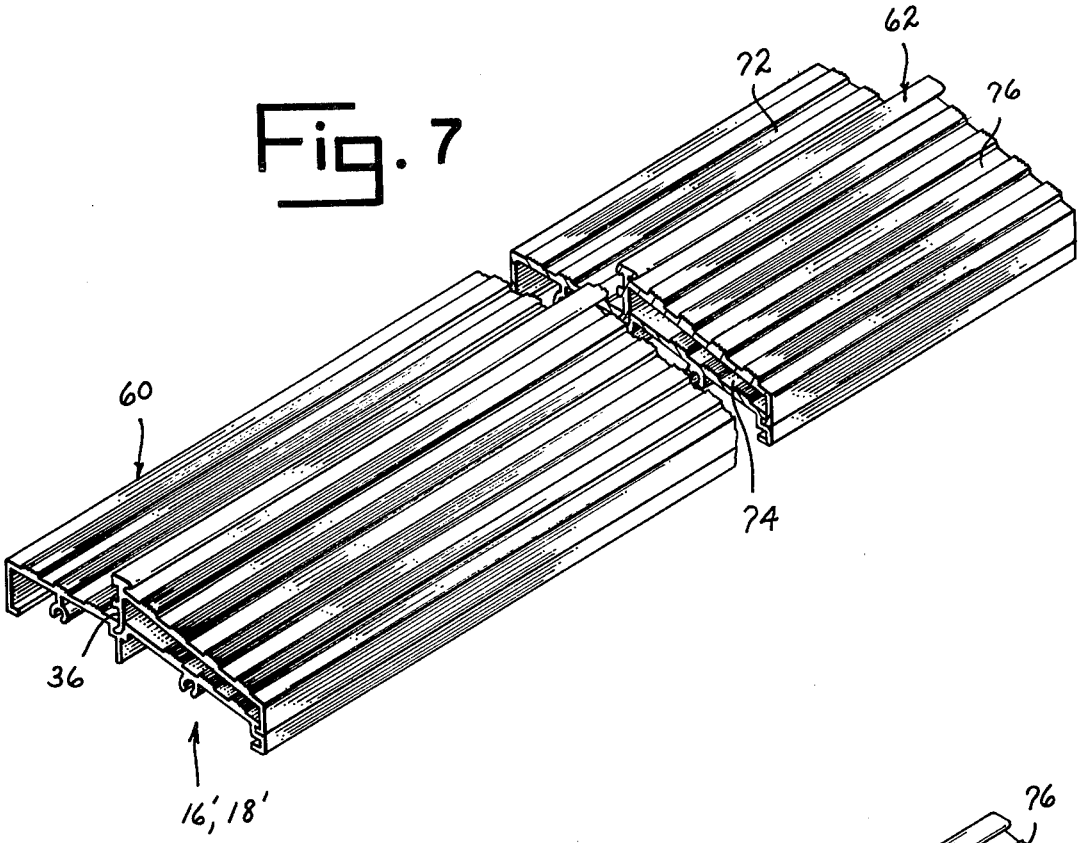
FIG. 7 is a fragmented perspective view of the two piece combined header and threshold used in the door assembly of FIG. 6.
Figure 8:
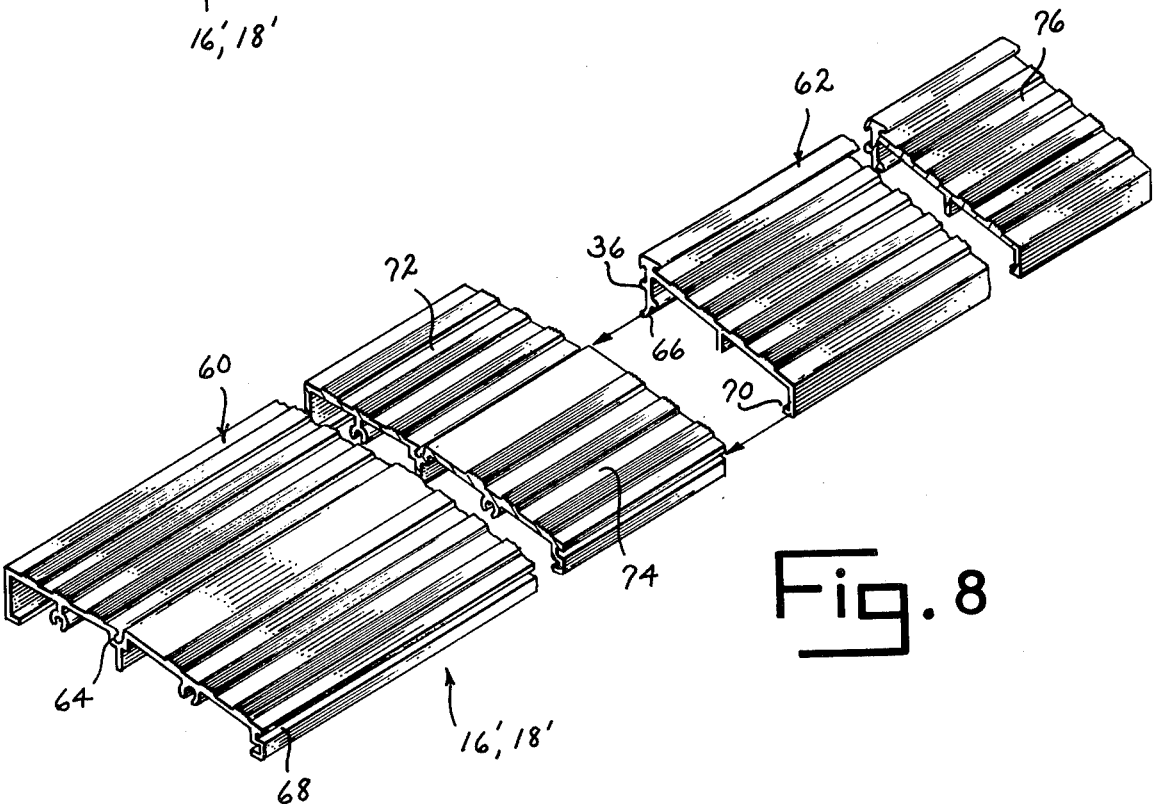
FIG. 8 is a perspective view of the two piece combined header and threshold shown in separated form.

In FIG. 6 the door assembly of FIGS. 1–5 is shown with headers and thresholds 16' and 18' of modified form. Each header and threshold 16' and 18' includes a base member 60 and a detachable attachment part 62. Attachment part 62 includes an end edge which when the part is connected to the base member forms shoulder 36 over which door panel 20 overlaps when closed. Base member 60 has a central groove 64 which divides the base member into two sections and into which lip 66 of attachment part 62 is interlockingly fitted. Additionally, base member 60 has an edge groove 68 formed in one of its sections into which lip 70 of the attachment part is fitted to connect the base and attachment parts together. The outer surfaces 72,74 of the base member sections are substantially flush and grooved to provide a foot hold. Likewise, the outer surface 76 of the attachment part is grooved to provide a foot hold when the part is used as a threshold, or a decor item when the part is used as a header.

Attachment part 62 can be connected to base member 60 by first inserting its outturned lip 66 into base member groove 64 and then pivoting the attachment part over section surface 74 of the base member until lip 70 of the attachment part snap fits into base member groove 68. Attachment part 62 may be detached from that base member 60 of the combined header and threshold being used in the installed assembly as the threshold to allow for the use of a flush or non-shouldered threshold.

It is to be understood that the invention is not to be limited to the details above given but may be modified within the scope of the appended claim.

What is claimed is:

1. An invertible prefabricated door assembly for mounting within a wall opening defined by a foundation and overhead support, said door assembly comprising a panel, first and second jambs, a first combined header and threshold means, a second combined header and threshold means, said jambs and both combined header and threshold means forming a four-sided enclosed frame, said panel fitting within said frame and having opposite vertical side edges, and hinge means pivotally connecting said panelat one side edge to said first jamb, each of said first and second combined header and threshold means being mountable either to the foundation or the overhead support of said wall opening depending upon the desired location of said hinge means, and including a first part which said panel overlaps when closed and a second part extending substantially forwardly from said first part and defining a threshold when located adjacent said foundation and a header when located adjacent said overhead support, said first part being offset from said second part and separated therefrom by a shoulder constituting a portion of each combined header and threshold means, and said shoulder being overlapped by said panel when the panel is closed.

* * * * *